US005827596A

United States Patent [19]

Donohue

[11] Patent Number: 5,827,596

[45] Date of Patent: Oct. 27, 1998

[54] LINING MATERIAL

[76] Inventor: James Donohue, 1111 Melissa Dr., San Antonio, Tex. 78213

[21] Appl. No.: 271,791

[22] Filed: Jul. 7, 1994

[51] Int. Cl.[6] ..... B32B 3/02

[52] U.S. Cl. ..... 428/96; 156/72; 156/148; 428/95; 428/97; 428/343; 428/352; 428/355; 442/101

[58] Field of Search ..... 428/95, 96, 263, 428/254, 289, 245, 250, 97, 355, 356, 343, 352; 156/72, 148, 435; 442/101

[56] References Cited

U.S. PATENT DOCUMENTS

| | | | |
|---|---|---|---|
| 4,515,851 | 5/1985 | Johnson | 428/250 |
| 5,045,375 | 9/1991 | Davis et al. | 428/97 |

*Primary Examiner*—James J. Bell
*Attorney, Agent, or Firm*—Choate, Hall & Stewart

[57] ABSTRACT

A lining material of a woven, knitted or non-woven substrate. The fibers of the substrate are coated with a gripping agent. The coated fibers grip a second structure to eliminate or diminish relative motion between the second structure and the substrate including the coated fibers.

8 Claims, 2 Drawing Sheets

LINING MATERIAL

BACKGROUND OF THE INVENTION

This invention relates to a lining or other material and more particularly to a slip resistant lining material for use within a shoe or other wearing apparel.

It has long been recognized that excess motion of the foot with respect to an enveloping shoe contributes significantly to a diminution of athletic ability. Such slipping and sliding of the foot with respect to the shoe can result in loss of balance, over-rolling the mid-sole/out-sole platform, heat build up, blisters, fatigue, stress fractures and the bruising of the toe sometimes referred to as black toe. Relative motion between foot and shoe also produces high stresses on the shoe itself sometimes resulting in shoe failures such as sidewall blow-outs, torn stitching, out-sole and mid-sole separation, component delamination and torn linings. In addition, such relative motion decreases the amount of energy available for the athletic endeavor whether it be walking or climbing or running and jumping.

Heretofore, the principal function of shoe lining materials has been to provide a base cushion or protective layer between the wearer's foot or sock and the upper and/or sock lining materials of a shoe. Insole and upper linings have traditionally been made with a leather or woven, knitted or non-woven top lining adhered to a foam backer. The most popular knitted and/or woven linings are smooth or non-gripping which actually enhances the probability of slippage inside the shoe during sporting activities, heavy lifting, rigorous walking or climbing. A need therefore exists for a unique lining material to reduce or eliminate excess motion of the foot within the shoe.

It is also been recognized that motion between a hand and an object to be gripped diminishes performance. The material of the present invention may therefore be used to form a grip on, for example, a tennis racket or to form a palm grip on sport gloves. The material may also form a surface of a tape which can serve as a wrap to provide slip resistance.

SUMMARY OF THE INVENTION

For the purpose of commercialization, the material described herein is known as TacLiner™. The primary purpose and unique benefit of TacLiner™ is to reduce or eliminate excess motion, slippage or wasted motion of the foot within the shoe during athletic and non-athletic activity.

In one aspect, the invention is a lining material including a woven, knitted or non-woven material having depending fibers extending outwardly from the material. The material need not necessarily have a nap. The fibers are coated with a gripping agent so that the coated fibers grip a second structure such as a sock or bare foot. Suitable coating materials include rubber-, urethane-, or synthetic- base polymers/monomers which form a fine-beaded or solid coating on the individual fibers or base surfaces of the lining material. It is preferred that the lining material be incorporated within a shoe for gripping a foot or sock of the wearer. The material may also be a tape for wrapping the foot or ankle prior to putting on a shoe.

In another aspect, the invention is directed to a method for making such a lining material. The method includes apparatus for coating fibers on the knit, non-woven or woven material with a gripping agent to prevent slippage.

DESCRIPTION OF THE PREFERRED EMBODIMENT

Figure 1:
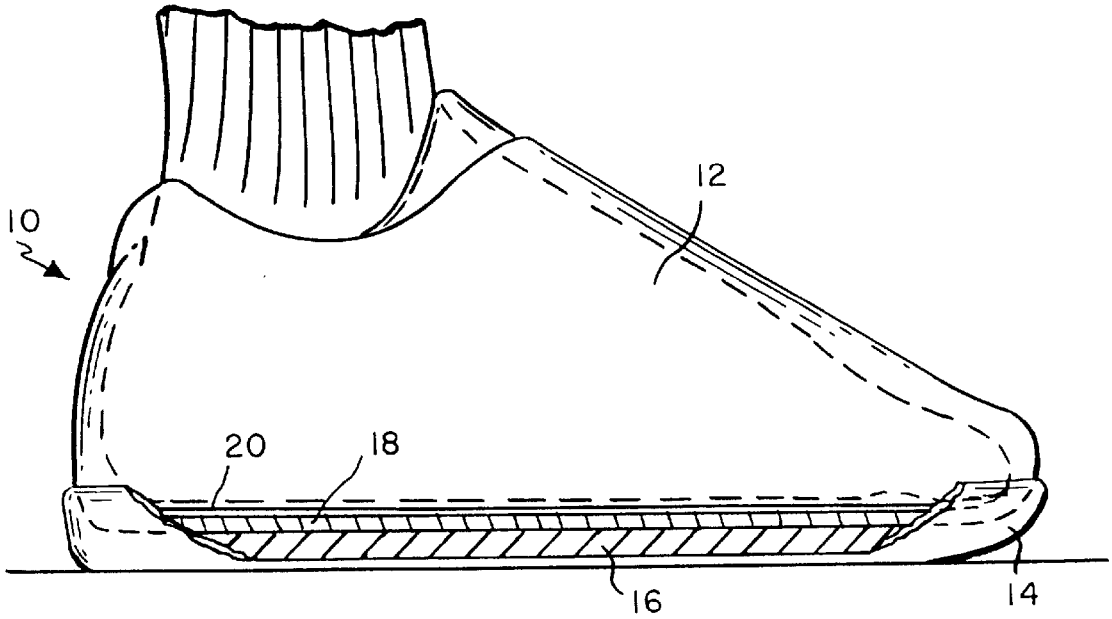
FIG. 1 is a side elevation view, with parts broken away, of a shoe incorporating the lining material of the invention.

With reference first to FIG. 1, a shoe 10 is illustrated with a sock 12 contained therein. FIG. 1 is merely exemplary and the gripping lining of the invention is effective with a bare foot. As is conventionally understood, the shoe 10 may include an outsole 14 and a midsole 16. The present invention can be used with any shoes which may be injection molded, vulcanized, flat lasted or welted. The inside may be permanently fixed or removable. In an embodiment of the present invention a sockliner foam 18 has adhered to its top surface a lining material 20 of this invention. The sockliner foam 18 bearing the lining material 20 of the invention is also shown in FIG. 2.

Figure 2:
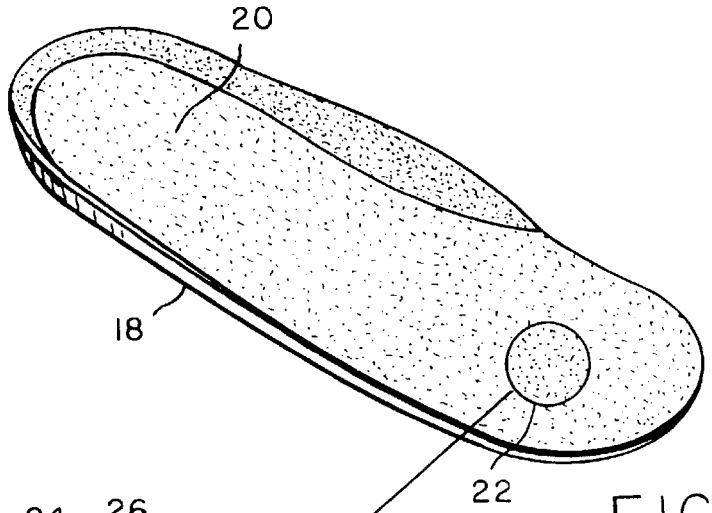
FIG. 2 is a perspective view of the lining material of the invention.
Figure 3:
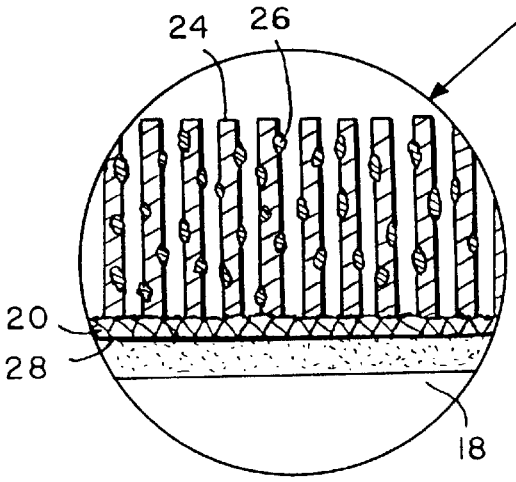
FIG. 3 is a cross-sectional view of coated fibers of the lining material of the invention.

With reference now to FIG. 3 which is an enlargement of the circular region 22 in FIG. 2, fibers 24 are coated with a suitable gripping material 26. In particular, the fibers 24 are micro-injected or coated with rubber-, urethane-, or synthetic- base polymer/monomers forming a random fine-beaded or solid coating such as the coating 26 on individual fibers 24 or other base surfaces of the lining material 20. This resulting material is known as TacLiner™. The material is not sticky or tacky to the touch. It is preferred that the lining material 20 be bonded to the sock liner foam 18 with an adhesive 28.

The coated fibers 24 gently grip uncoated fibers of a wearer's sock 12 or grip a bare foot to help hold the foot (not shown) in place on the platform of the shoe 10 during both sport and non-sport activity. It is to be noted that the gripping effects of the lining material of the invention are designed to increase as pressure or body weight is applied to the material. A light pressure/body weight will result in virtually no slip resistance, while increased pressure/body weight results in a high degree of slip resistance.

The lining material 20 of the invention may be made of knitted, woven and non-woven base materials with or without a nap. Colors of the coatings 26 materials may be clear, colored or multicolored according to design preference. The TacLiner™ material of the invention may be combined with a variety of insole and/or lining foams and utilized in molded and non-molded footwear components. The lining material of the invention is non-abrasive, breathable and highly resilient even after exposure to moisture in the form of perspiration.

Figure 4:
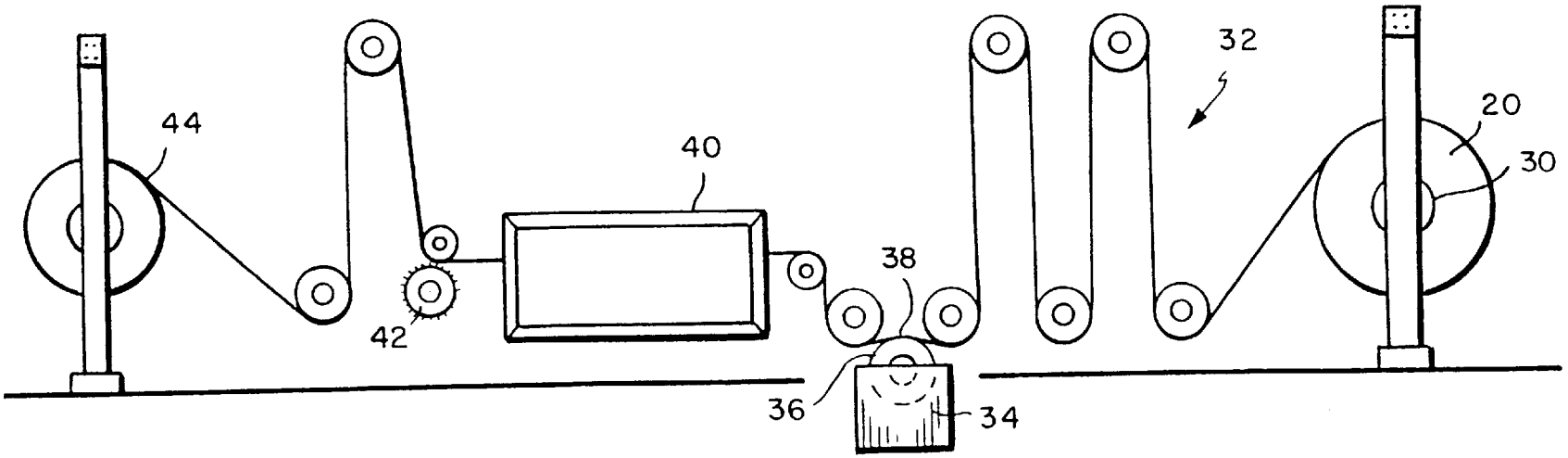
FIG. 4 is a schematic illustration of the manufacturing process for making the materials of the invention.

An exemplary process for manufacturing the lining material of the present invention will now be discussed in conjunction with FIG. 4. A bolt of the lining material 20 is mounted onto a horizontal spindle 30 at the first stage of the coating/finishing system. An open end of the bolt is attached by clips or pins (not shown) and is drawn across tension spools 32. A coating bath 34 includes the coating material 26 to be applied to the fibers 24. An injection roller or drum 36 passes through the coating bath 34 and thereafter contacts the material 20 at the location 38. In a preferred embodiment, the injection roller 36 is an elongated gravure-like drum having uniform bristles or spikes, surface patterns and/or textures so as to cause the fibers 24 to extend from the surface of the material 20 and to coat the fibers 26. After being coated, the material 20 passes through a drying tunnel

40 and is then finished by a bristle brush finishing wheel 42. Thereafter, the material 20 is wound onto a take-up spool 44.

For materials requiring heavy coatings of rubber-, urethane-, or synthetic- base polymer/monomer, the coating bath 34 and injection roller 36 stages may be replaced by a pressurized sprayer (not shown) mounted and activated above the material as it is drawn through the coating system. With either method, coatings may be injected through the top side (nape side) and/or backside (knit side) of a given material. It will be appreciated by those skilled in the art that other processes and machines may be used to make the lining material of the invention.

What is claimed is:

1. Lining material comprising:

a knitted, woven or non-woven material coated with a non-tacky gripping agent forming a fine beaded or solid coating whereby the material grips a second structure.

2. The lining material of claim 1 wherein the coating material is selected from the group comprising rubber base, urethane base or synthetic base polymers or monomers.

3. Shoe comprising a lining including a knitted, woven or non-woven material coated with a non-tacky gripping agent forming a fine beaded or solid coating whereby the coated material grips a second structure.

4. Lining material comprising:

a knitted, woven or non-woven material having depending fibers extending outwardly from the material; and a non-tacky gripping agent forming a fine beaded or solid coating on the dependent fibers whereby the coated fibers grip a second structure.

5. The lining material of claim 4 wherein the gripping agent is selected from the group comprising rubber base, urethane base or synthetic base polymers or monomers.

6. A method for making a lining material comprising:

providing a lining material having fibers; and coating the fibers of the lining material with a non-tacky gripping agent forming a fine beaded or solid coating.

7. The method of claim 6 further including a step of distending the fibers before coating.

8. The method of claim 7 wherein the step of distending the fibers comprises providing a drum having bristles or spikes adapted to distend the fibers.

* * * * *